US005480329A

United States Patent [19]

Karlström et al.

[11] Patent Number: 5,480,329

[45] Date of Patent: Jan. 2, 1996

[54] PLUG CONNECTOR HOUSING

[76] Inventors: Anders Karlström, Dammweg 9, D-91728 Gnotzheim; Herbert Haiduk, Am Einsiedel 24, D-91785 Pleinfeld; Gerhard Schüle, Kaadenerstr. 3, D-91785 Pleinfeld, all of Germany

[21] Appl. No.: 214,898

[22] Filed: Mar. 17, 1994

[30] Foreign Application Priority Data

Mar. 19, 1993 [DE] Germany ..... 9304119 U

[51] Int. Cl.[6] ..... H01R 13/514

[52] U.S. Cl. ..... 439/731; 439/362; 439/701

[58] Field of Search ..... 439/372, 359, 439/362, 364, 687, 696, 701, 717, 731

[56] References Cited

U.S. PATENT DOCUMENTS

| | | | |
|---|---|---|---|
| 1,800,728 | 4/1931 | Hertzberg | 439/731 |
| 1,866,407 | 7/1932 | Guett | 439/731 |
| 1,884,121 | 10/1932 | Muldoon | 439/731 |
| 3,781,766 | 12/1973 | Teagno et al. | 439/731 X |
| 4,735,583 | 4/1988 | Rudy, Jr. et al. | 439/350 |

FOREIGN PATENT DOCUMENTS

| | | |
|---|---|---|
| 2915574 | 4/1979 | Germany . |
| 2133638 | 7/1984 | United Kingdom . |

*Primary Examiner*—Khiem Nguyen

[57] ABSTRACT

A plug connector housing is provided having a mounting device and a pair of mating housing parts. The mounting device is formed by at least one spring clamp. The at least one spring clamp is snapped into engagement with the mating housing parts to thereby form the plug connector housing.

15 Claims, 2 Drawing Sheets

PLUG CONNECTOR HOUSING

FIELD OF THE INVENTION

A plug connector housing is provided that is subdivided into two housing parts that are divided longitudinally in the direction of insertion, whereby the housing parts are held together with a mounting device.

BACKGROUND OF THE INVENTION

Plug connectors having connector housings that are subdivided longitudinally into two housing parts, in the direction of insertion, are particularly used as interface plugs for computers. In some cases, two plug connectors to be joined are each located on a housing wall of two different apparatuses, such as computers, printers, or other machines to be connected. In these cases, the two plug connectors are held together by the two apparatuses. In other cases, a terminating plug connector is attached to a mating plug connector or to an apparatus wall by means of a mounting device. This may be accomplished with threaded bolts, for example. Such an attachment method is intended to prevent the plug connector from becoming detached from its connection, while also providing mechanical relief for the contacts of the plug connector.

With conventional plug connector housings, the two housing parts are either screwed together or they are held together by means of catch prongs. With small connector housings, such catch prongs are small delicate elements that do not provide much holding power and can also be broken off easily. Additional mounting elements for attaching the plug connector housing to a mating plug connector or an apparatus wall may also be necessary. With such plug connector housings, there is not only the danger that loose individual parts such as mounting elements in the form of threaded bolts may be lost, but also the assembly process is relatively complicated. The two housing parts must be positioned at the site of use and then locked or screwed together. To secure such a plug connector housing on a mating plug connector or an instrument wall, the threaded bolts are then optionally inserted into threaded bolt receptacle channels.

The foregoing illustrates limitations known to exist in present plug connector housings. Thus, it is apparent that it would be advantageous to provide an improved plug connector housing that permits a simple assembly process for joining two housing parts of a plug connector housing, including the positioning of any necessary mounting devices. Such a suitable alternative is provided, including features more fully disclosed hereinafter.

SUMMARY OF THE INVENTION

A plug connector housing is provided having a mounting device and housing parts which are subdivided longitudinally in the direction of plug insertion. The mounting device is formed by at least one spring clamp that is snapped onto the assembled housing parts. The mounting device extends over at least one of the two opposing longitudinal sides of the plug connector housing. At least one mounting element is provided that is insertable through a mounting element receptacle channel that opens into a plug end face of the plug connector housing. The mounting element is operable to secure the plug connector housing with a mating plug connector. The spring clamp retains the mounting element in a fashion that permits independent mounting element movement with respect to the spring clamp, but does not permit the mounting element to be separated from the spring clamp. When the spring clamp is snapped onto the plug connector housing, the spring clamp is held in alignment by means of a mounting element receptacle channel, and is brought into a mounting connection with a mating plug connector assembly. A mounting element receptacle channel may be provided on each of two opposing longitudinal sides of the plug connector housing. A spring clamp may be provided on each side of a plug connector housing.

The foregoing and other aspects will become apparent from the following detailed description of the invention when considered in conjunction with the accompanying drawing figures.

DETAILED DESCRIPTION OF THE INVENTION

An improved plug connector housing comprises a mounting device and a pair of housing parts. The mounting device is formed by at least one spring clamp which snaps onto the pair of housing parts. One embodiment of the present invention provides for mounting elements to be used in attaching the plug connector housing to a mating plug connector or to an apparatus wall. The mounting elements may be in the form of threaded bolts. The at least one spring clamp retains a mounting element in a fashion which permits the mounting element to move relative to the spring clamp, but which does not permit the mounting element to be separated from the spring clamp.

The two housing parts may be held together by two spring clamps, i.e. one spring clamp on each side of the plug connector housing. Alternatively, a spring clamp may be provided on only one longitudinal side of the plug connector housing, wherein a hinge is disposed on the other longitudinal side. In the case of plastic housings, the hinge may comprise a film hinge.

In another embodiment of the present invention, each spring clamp is provided with a catch spring part on each of its two longitudinal edges. The plug connector housing has a complementary catch recess or a complementary catch projection on each of the two longitudinal edges of the two longitudinal sides. The threaded bolts are either held in position by being secured between the spring clamp and the plug connector housing when the spring clamps are locked onto the connector housing, or the spring clamps are each designed with a threaded bolt mount that holds the threaded bolts on the spring clamp regardless of whether or not the spring clamp is snapped onto the plug connector housing. This also applies when using mounting elements other than screws or bolts.

An embodiment whereby each spring clamp is connected like a hinge to each of the two housing parts is especially advantageous. This permits not only an especially simple method of assembling the two housing parts to form the plug connector housing, but it also assures to a great extent that all the required parts will be available when required. All that is required is to hold the two housing parts together and to pivot the two spring clamps into their snap or locking position.

Another embodiment of the present invention is obtained when the mounting element or threaded bolt fastener is designed in one piece with a spring clamp, for example, in the form of an eyelet that is punched and bent out of the material of the spring clamp.

In yet another embodiment of the present invention, the two housing parts and two spring clamps are identical in design. As long as there is an even number of housing parts and spring clamps, a plurality of plug connector housings may be assembled therefrom.

Figure 1:
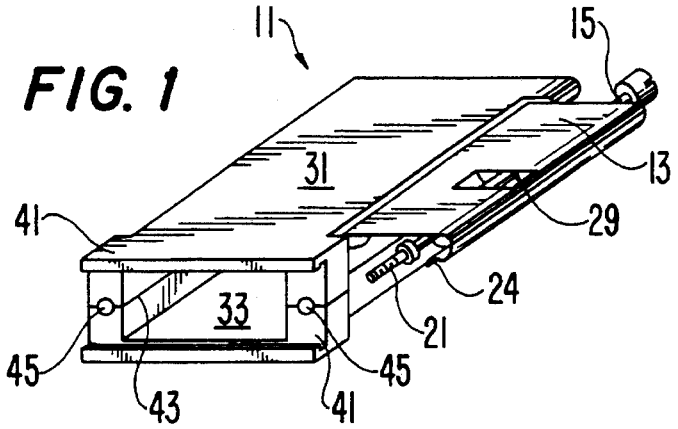
FIG. 1 shows a diagram of the plug connector housing of the present invention having a spring clamp and threaded bolt.

The invention is best understood by reference to the accompanying figures:

FIG. 1 shows a unit consisting of a plug connector housing 11, spring clamps 13, and threaded bolts 15.

Figure 2:
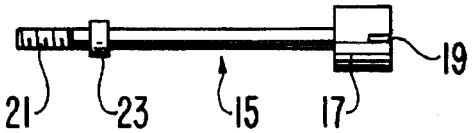
FIG. 2 shows a side view of a threaded bolt.

FIG. 2 shows a side view of a threaded bolt 15 having a head 17 with a slot 19 for use with a screwdriver. Threaded bolt 15 is provided with a thread 21 on the end opposite head 17. A collar 23 is provided between the head 17 and the thread 21 of the threaded bolt.

Figure 3:
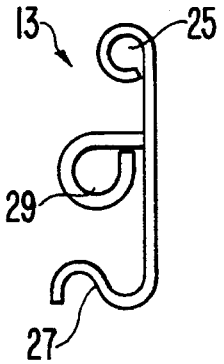
FIG. 3 shows a side view of a spring clamp.

FIG. 3 shows a side view of a spring clamp 13. Spring clamp 13 has a hinge sleeve 25 disposed on a top end in this side view. On an opposite end, spring clamp 13 is provided with a catch spring part 27 that is S-shaped in the side view. There is an eye-shaped threaded bolt fastener 29 disposed between hinge sleeve 25 and catch spring part 27. Threaded bolt fastener 29 is comprised of the same sheet material as the spring clamp 13.

Figure 4:
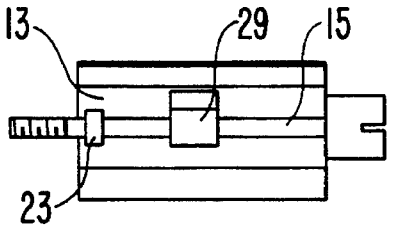
FIG. 4 shows a spring clamp which retains a threaded bolt.

FIG. 4 shows a side view of a spring clamp 13 with the threaded bolt held on it. In order to assemble threaded bolt 15 on spring clamp 13, the eye of the threaded bolt fastener 29 is bent around the threaded bolt 15 after applying the threaded bolt 15 to the spring clamp 13. Alternatively, the eye is first bent to a diameter that permits the collar 23 of the threaded bolt 15 to pass therethrough. Thereafter, the eye-shaped threaded bolt fastener is then clamped to a dimension which permits mobility of the threaded bolt 15 therein, but does not permit the collar 23 to pass therethrough. In this way the threaded bolt 15 is held on spring clamp 13 so that it cannot be lost.

Figure 5:
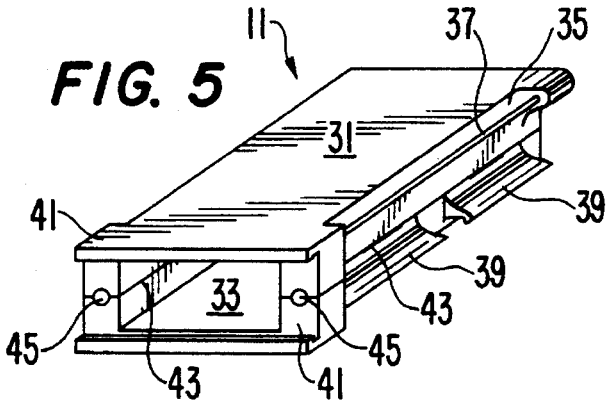
FIG. 5 shows two assembled housing parts.

FIG. 5 shows a plug connector housing 11 consisting of housing part which is shown at the top in this partial view and housing part 33 which is shown at the bottom. In this embodiment, the two housing parts are identical so that only a single injection mold is needed to manufacture the plug connector housing 11. Each of the two housing parts 31 and 33 has a longitudinal recess 35 that runs in the longitudinal direction of the housing on one longitudinal side with a hinge shaft 37 extending over it and forming a swivel hinge together with the hinge sleeve 25 of the spring clamp 13. Each housing part has two catch projections 39 on the longitudinal side opposite the longitudinal recess 35 such that these two catch projections work together with the S-shaped catch spring part 27 of the spring clamp 13 to form a locking connection or a snap-lock connection.

When two such housing parts 31 and 33 are assembled to form a plug connector housing 11, there is one hinge shaft 37 and a pair of catch projections 39 on each of the two longitudinal sides.

The plug connector housing 11 has a bolt receptacle projection 41 projecting in a direction transverse to the longitudinal axis of the housing on each side of the longitudinal end at the front in FIG. 5. In the plane of a housing seam 43, between the upper housing part 31 and the lower housing part 33, each bolt receptacle projection 41 has a bolt receptacle channel 45 running through it in the longitudinal direction of the housing.

FIG. I shows a completely assembled plug connector housing 11 with the spring clamps 13 and threaded bolts 15. The spring clamp shown here is in the open position.

One proceeds as follows in order to assemble such a plug connector housing 11.

Two threaded bolts 15 are first secured in the threaded bolt fastener 29 of a spring clamp 13 in order to permanently mount them. The two resulting subunits are then assembled on each side of the two housing parts 31 and 33 by combining the hinge sleeves 25 of the two spring clamps 13 with the hinge shafts 37 of one of the two housing parts 31 and 33 to form a hinge. When the two housing parts 31 and 33 are held together along the seam 43, the two spring clamps 13 are brought into their locking or snap lock positions where the catch spring parts 27 snap over the respective catch projections 39 to lock them. The two housing parts 31 and 33 are then combined to form a plug connector housing 11 and the longitudinal axes of the threaded bolts 15 are aligned with the respective bolt receptacle channels 45.

In order to assemble the resulting plug connector housing on a mating plug connector or on an apparatus wall, the thread of the threaded bolt 15 is passed through the bolt receptacle channels 45 and is inserted into the thread of the mating plug connector or the apparatus wall. The threaded bolt 15 is then tightened in the mating plug connector or the instrument wall.

Figure 6:
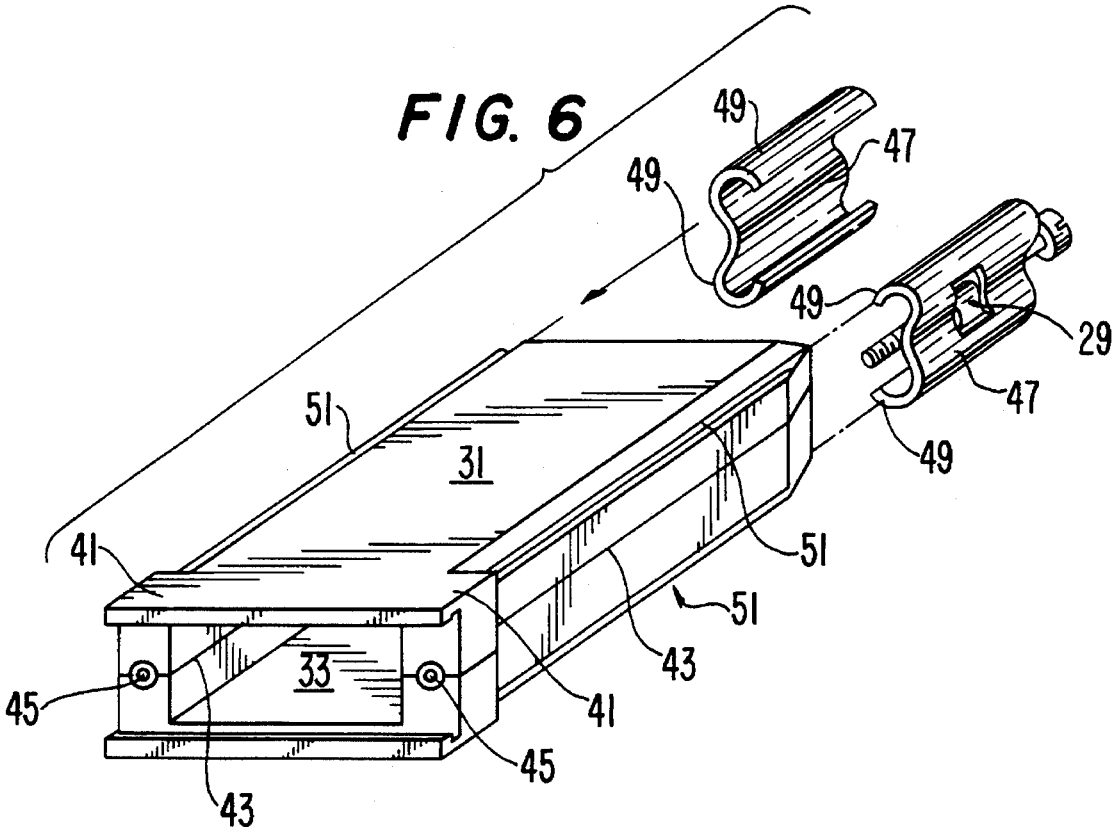
FIG. 6 shows a plug connector having two spring clamps disposed in a pre-assembled orientation.

FIG. 6 shows an alternative embodiment of this invention whereby the two housing parts 31 and 33 are held together by means of two spring clamps 47, each of which has a catch spring part 49 on two longitudinal ends. Housing parts 31 and 33 are each provided with a catch groove 51 on their longitudinal side edges into which the spring clamps 47 engage or can be inserted. FIG. 6 shows the insertion of the catch spring parts 49 into the catch grooves 51 so that the spring clamps are pushed from the rear side onto the plug connector housing.

Figure 7:
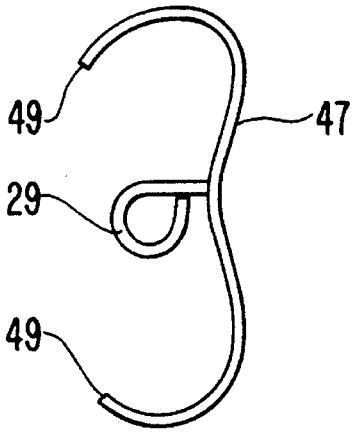
FIG. 7 shows an end view of an enlarged spring clamp.

The threaded bolts are either secured between the plug connector housing 11 and the spring clamps 47 or they are held on the spring clamps 47 by means of threaded bolt fastener 29 in such a way that they cannot be lost. FIG. 7 shows an enlarged side view of a spring clamp 47 with a bolt fastener.

We claim:

1. A plug connector housing comprising:

a pair of housing pads which are subdivided longitudinally in a direction Of plug insertion, the housing pads defining at least one channel in one of two opposing longitudinal sides of the housing pads; at least one spring clamp that is snapped onto the pair of housing parts, which are assembled such that the at least one spring clamp extends over one of the two opposing longitudinal sides of the housing pads; and at least one mounting element insertable through the at least one channel, the at least one mounting element being positioned by the at least one spring clamp, whereby the at least one mounting element extends out an end face of the plug connector housing to secure the plug connector housing to a mating plug connector, the at least one spring clamp is provided with a mounting element fastener for positioning the at least one mounting element such that the mounting element is moveable with respect to the at least one spring clamp, but is not separable therewith, and wherein when the at least one spring clamp is snapped onto the plug housing, the mounting element is disposed in alignment with the channel.

2. A plug connector housing according to claim 2 wherein a channel is provided on each of the two opposing longitudinal sides of the plug connector housing, and claim an individual spring clamp is provided on each of the two opposing longitudinal sides of the plug connector housing.

3. A plug connector housing according to claim 2 wherein the at least one mounting element is a threaded bolt.

4. A plug connector housing according to claim 2 wherein the at least one spring clamp has a catch spring part, and the plug connector housing has a complementary catch recess on at least one of the two opposing longitudinal sides.

5. A plug connector housing according to claim 3 wherein said mounting element fastener is formed by claim the at least one spring clamp.

6. A plug connector housing according to claim 5 wherein the at least one mounting element is secured by means of claim the mounting element fastener.

7. A plug connector housing according to claim 6 wherein the at least one spring clamp is designed in one piece with the mounting element fastener.

8. A plug connector housing according to claim 7 wherein the mounting element fastener is formed by an eyelet that is stamped and bent out of the at least one spring clamp.

9. A plug connector housing according to claim 1 wherein a first longitudinal edge of the at least one spring clamp is hingedly connected to one of the two housing parts and a second longitudinal edge is provided with a catch spring part that is engageable with the other housing part.

10. A plug connector housing according to claim 9 wherein at least one of the two housing parts is provided with a hinge shaft for a hinge sleeve of the respective spring clamp on one longitudinal side and at least the other housing part has at least one catch projection on the connector housing on the same longitudinal side so as to work with the catch spring part of the spring clamp that is hingedly connected to the housing part.

11. A plug connector housing according to claim 10 wherein each housing part is provided with a hinge shaft on one longitudinal side and at least one catch projection on the opposite longitudinal side.

12. A plug connector housing according to claim 10 wherein the two housing parts are held together on one longitudinal side of the plug connector housing by means of a hinge, and the two housing parts are held together by means of a spring clamp on the other longitudinal side of the plug connector housing.

13. A plug connector housing according to claim 5 wherein the threaded bolt is held in the mounting element fastener of the at least one spring clamp in such a way that it can be isolated and that it can slide in the direction of insertion of the plug connector housing so that the threaded bolt can be inserted through the channel in the direction of insertion of the plug connector housing when the spring clamp is snapped onto the plug connector housing, and rotated in the channel for the purpose of tightening it in a mating plug connector.

14. A plug connector housing according to claim 1 wherein the channel is open toward the longitudinal side of the plug connector housing and the respective mounting element is inserted into the channel in a direction transverse to the direction of insertion of the plug such that the mounting element that is held on the respective spring clamp can be inserted into the channel by the operation of snapping the spring clamp in position on the plug connector housing and screwed to the mating plug connector.

15. A plug connector housing according to claim 1 having two spring clamps, and wherein both housing parts and the two spring clamps have identical shapes.

* * * * *